US011288904B2

(12) United States Patent
Kunieda et al.

(10) Patent No.: US 11,288,904 B2
(45) Date of Patent: Mar. 29, 2022

(54) GATE DEVICE AND SYSTEM

(71) Applicant: Panasonic Intellectual Property Management Co., Ltd., Osaka (JP)

(72) Inventors: Yoshinori Kunieda, Tokyo (JP); Masao Kubota, Tokyo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/255,296

(22) PCT Filed: Jun. 18, 2019

(86) PCT No.: PCT/JP2019/024053
§ 371 (c)(1),
(2) Date: Dec. 22, 2020

(87) PCT Pub. No.: WO2020/004134
PCT Pub. Date: Jan. 2, 2020

(65) Prior Publication Data

US 2021/0166512 A1 Jun. 3, 2021

(30) Foreign Application Priority Data

Jun. 28, 2018 (JP) ..... JP2018-123002

(51) Int. Cl.
*G07C 9/00* (2020.01)

(52) U.S. Cl.
CPC ..... *G07C 9/00563* (2013.01)

(58) Field of Classification Search
None
See application file for complete search history.

(56) References Cited

U.S. PATENT DOCUMENTS 6,819,219 B1 * 11/2004 Bolle ..... G07C 9/257 340/5.52
9,524,598 B2 * 12/2016 Jang ..... G06K 9/00288
9,582,941 B2 * 2/2017 Reymann ..... G07C 9/27
10,096,180 B2 * 10/2018 Warnitz ..... G07C 9/10
(Continued)

FOREIGN PATENT DOCUMENTS

JP S57-131767 U 8/1982
JP 2005-063172 A 3/2005
(Continued)

OTHER PUBLICATIONS

Official Communication issued in International Bureau of WIPO Patent Application No. PCT/JP2019/024053, dated Aug. 20, 2019, along with an English translation thereof.

*Primary Examiner* — Muhammad Adnan
(74) *Attorney, Agent, or Firm* — Greenblum & Bernstein, P.L.C.

(57) ABSTRACT

This gate device has: a pair of left and right passage walls that form a passage; opening and closing shutters that are attached to the passage walls and restrict a person from passing through the passage; and an arch which is attached to bridge the pair of passage walls, has a height at which a person can pass therethrough in the attached state, and has cameras which capture an image of a person passing through the passage and wiring for supplying electric power to an electric device provided in the passage walls.

12 Claims, 7 Drawing Sheets

(56) References Cited

U.S. PATENT DOCUMENTS 10,108,618 B2 * 10/2018 Vlugt ..... G07B 15/04
10,490,087 B2 * 11/2019 Dennerline ..... G01C 21/20
10,534,956 B1 * 1/2020 Trelin ..... G06Q 10/063114
10,657,782 B2 * 5/2020 Bradley ..... G08B 13/19613
10,699,501 B2 6/2020 Kunieda et al.
10,931,887 B2 2/2021 Nozue et al.
2003/0196097 A1 * 10/2003 Korosec ..... G07C 9/22 713/185
2004/0083394 A1 * 4/2004 Brebner ..... G06Q 20/382 726/19
2005/0093697 A1 * 5/2005 Nichani ..... G06T 7/593 340/545.1
2007/0122011 A1 * 5/2007 Takizawa ..... G07C 9/10 382/118
2007/0133844 A1 * 6/2007 Waehner ..... G06K 9/2036 382/118
2009/0032585 A1 * 2/2009 Kocznar ..... G07C 9/10 235/382
2009/0128284 A1 * 5/2009 Floyd ..... G07C 9/10 340/5.3
2010/0033572 A1 * 2/2010 Trela ..... G07C 9/27 348/152
2010/0082490 A1 * 4/2010 Rosenblatt ..... G06Q 20/382 705/64
2010/0280958 A1 * 11/2010 Hasson ..... G07C 9/28 705/75
2010/0308108 A1 * 12/2010 Choi ..... G07C 9/27 235/382
2011/0001606 A1 * 1/2011 Charych ..... G07C 9/28 340/5.7
2011/0167727 A1 7/2011 Kamise et al.
2011/0277518 A1 * 11/2011 Lais ..... G07C 9/37 70/101
2013/0205666 A1 * 8/2013 Fortin ..... E05F 15/78 49/13
2015/0317841 A1 * 11/2015 Karsch ..... G07B 15/06 348/149
2016/0217663 A1 * 7/2016 Shichiri ..... G08B 13/08
2016/0281424 A1 * 9/2016 Grillberger ..... E06B 11/08
2017/0070501 A1 * 3/2017 Saito ..... H04L 63/0861
2017/0365029 A1 * 12/2017 Kim ..... G06Q 50/30
2018/0018838 A1 * 1/2018 Fankhauser ..... G07C 9/257
2018/0302416 A1 * 10/2018 Einberg ..... H04L 63/083
2019/0166120 A1 * 5/2019 Goenka ..... G08B 13/22
2019/0206171 A1 * 7/2019 Sasaki ..... G07C 9/10
2019/0279446 A1 9/2019 Kunieda et al.
2019/0385395 A1 * 12/2019 Kunieda ..... G07C 9/15
2020/0211309 A1 * 7/2020 Daniel ..... H04W 12/63
2020/0342086 A1 * 10/2020 Oung ..... G06K 9/00926
2020/0410832 A1 * 12/2020 Szczygiel ..... G07C 9/29
2021/0006858 A1 * 1/2021 Peterson ..... H04L 63/107
2021/0056793 A1 * 2/2021 Sato ..... G07C 11/00
2021/0126912 A1 * 4/2021 MacLean ..... H04W 12/065

FOREIGN PATENT DOCUMENTS

JP 2005-204117 A 7/2005
JP 2009-199472 A 9/2009
JP 2009199472 A * 9/2009
JP 4943000 B2 5/2012
JP 2016-053896 A 4/2016
JP 2016053896 A * 4/2016

* cited by examiner

GATE DEVICE AND SYSTEM

TECHNICAL FIELD

The present disclosure relates to a gate apparatus, and a system including the gate apparatus.

BACKGROUND ART

In airports, event sites, and various other facilities, there are areas where only certain authorized persons are allowed to pass, for security and other reasons. Such areas are equipped with gate devices that allow only authorized persons to pass.

For example, PTL 1 discloses a gate apparatus configured to be disposed at an entrance of event sites and various other facilities.

CITATION LIST

Patent Literature

PTL 1
Japanese Patent Publication No. 4943000

SUMMARY OF INVENTION

Technical Problem

Incidentally, gate apparatuses of such types require a wiring for supplying power to a motor for driving an open-close shutter, and the like. In general, such a wiring is laid on the floor, and covered with a floor material. Consequently, the part of the floor surface where the wiring is laid is raised.

In practice, an open-close shutter is attached to a pair of left and right passage walls of the main body of s gate apparatus, and a motor for driving each open-close shutter is provided in each passage wall. A wiring for supplying power to the motor is extended to the pair of left and right passage walls. Consequently, the wiring is laid to cross the passage of the gate apparatus and the floor surface is raised to cross the passage of gate apparatus.

Typically, the bulge on the floor is only a few centimeters in height, which is not a big problem for people to pass through, but it is troublesome to push a heavy baggage cart over it. Especially at the baggage handover area at the airport, many people push heavy carts, and therefore the raised floor caused by the wiring is a nuisance.

In addition, a structure where the wiring is arranged on the floor has a disadvantage that the flexibility for layout changes is low, because if the passage width of the gate device (i.e., the width between the left and right aisle walls) is changed due to a change in the layout of the gate device, etc., the floor surface needs to be stripped off, etc.

According to an embodiment of the present disclosure, a gate apparatus that can eliminate inconveniences of wirings is provided. In addition, according to an embodiment of the present disclosure, the security in a system including a gate apparatus is improved.

Solution to Problem

A gate apparatus according to an embodiment of the present disclosure includes a pair of left and right passage walls defining a passage; an open-close shutter attached to the passage walls and configured to limit passing of a person through the passage; and an arch attached as a bridge between the passage walls, and having a height enough to allow passing of a person in a state where the arch is attached, the arch including a camera configured to capture an image of a person passing through the passage and a wiring configured to supply power to an electric apparatus provided in the passage walls.

A system according to an embodiment of the present disclosure includes a terminal configured to perform a check-in process of a user when user information is input, and a gate apparatus including a camera and an open-close shutter, and configured to control opening and closing of the open-close shutter at least on a basis of a result of a collation of a face image of the user input to the terminal and an face image of the user captured by the camera; and a passage limitation process unit configured to monitor a use state of the terminal by the user and a use state of the gate apparatus by the user and perform a passage limiting process of limiting passing of the user through the gate apparatus on a basis of the use states.

Advantageous Effects of Invention

According to an embodiment of the present disclosure, it is possible to achieve a gate apparatus that can eliminate inconveniences of wirings.

In addition, according to an embodiment of the present disclosure, it is possible to achieve a system with improved security.

Further advantages and effects in one form of the present disclosure are apparent from the specification and the drawings. Such advantages and/or effects are provided by several embodiments and the features described in the specification and drawings, respectively, but not necessarily all of them need to be provided in order to obtain one or more of the same features.

DESCRIPTION OF EMBODIMENTS

An embodiment of the present disclosure is elaborated below with reference to the accompanying drawings.

1. SYSTEM CONFIGURATION

Figure 1:
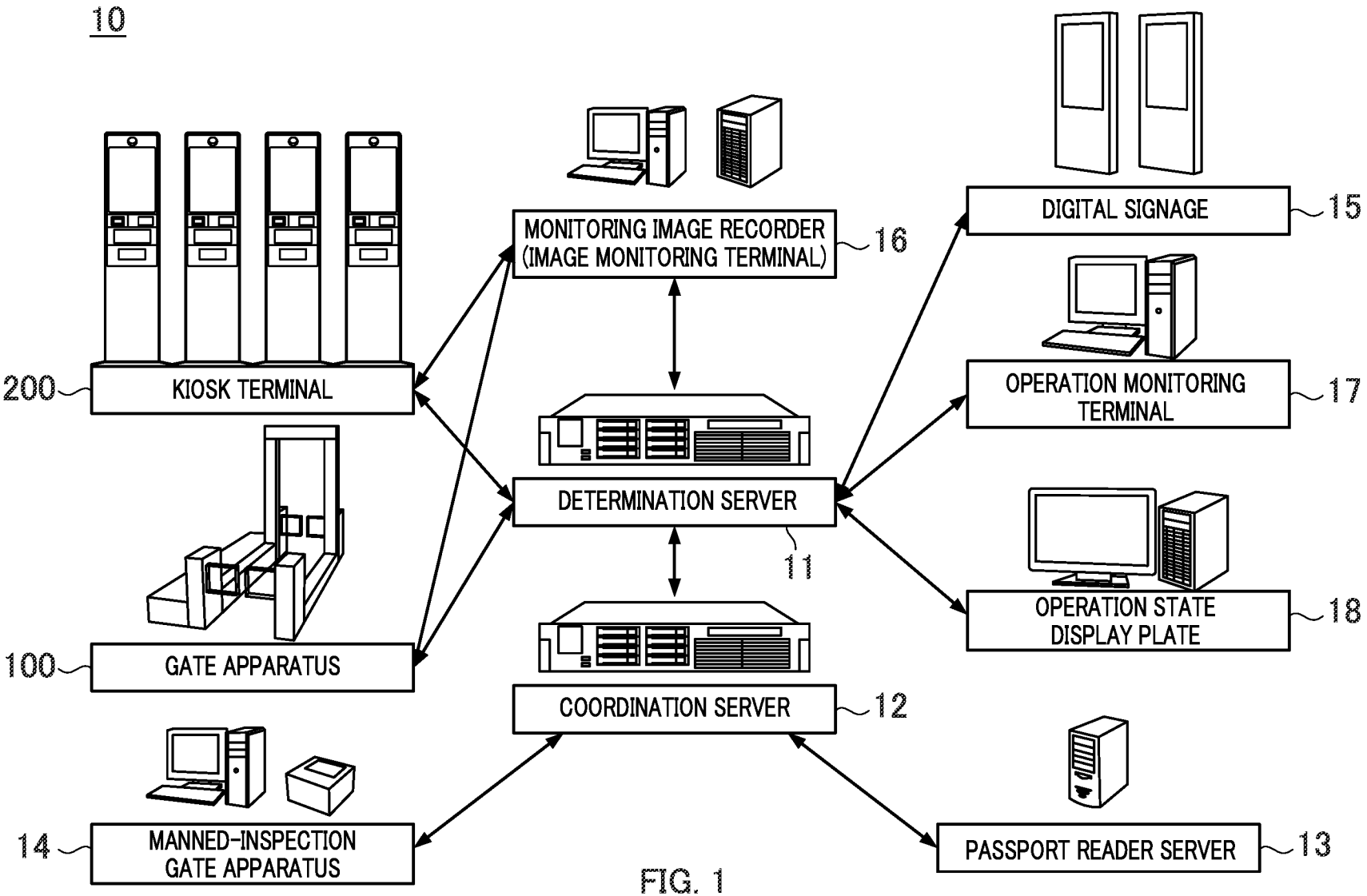
FIG. 1 is a drawing illustrating an overview of a system in which a gate apparatus of an embodiment of the present disclosure is used.

First, an overview of a system using a gate apparatus of an embodiment of the present disclosure is described with reference to FIG. 1. System 10 includes gate apparatus 100, KIOSK terminal 200, determination server 11, coordination server 12, passport reader server 13, manned-inspection gate apparatus 14, digital signage 15, monitoring image recorder 16, operation monitoring terminal 17, and operation state display plate 18.

Gate apparatus 100 and KIOSK terminal 200 are installed in an arrival baggage handover area in a lobby of an airport. More specifically, KIOSK terminal 200 is installed in a baggage handover area, and gate apparatus 100 is installed in a customs gate at an exit of a baggage handover area.

KIOSK terminal 200 is an input terminal for the user to perform an automatic check-in. KIOSK terminal 200 includes a passport reader, a facial recognition camera, a touch panel, a QR code (registered trademark) reader and the like. The user can input a customs declaration from the touch panel. In addition, by inputting the contents of a customs declaration form and a passport to his or her smartphone in advance to output to display the content in the form of a QR code on the smartphone, the user can cause the QR code reader of the KIOSK terminal 200 to scan the QR code. In this manner, the user can create a customs declaration in advance. KIOSK terminal 200 makes identification by collating the face image of the passport and the face image of a facial recognition camera. In addition, KIOSK terminal 200 outputs the face image to determination server 11 as a registered face image.

Gate apparatus 100 captures the user's face image with a camera for facial photography, and collates the face image and the registered face image of determination server 11 to confirm the registered identification (i.e., to perform walk-through facial recognition). When it is confirmed that the user is the registered user and determination server 11 has determined that passing is allowed with no problem, gate apparatus 100 opens an open-close shutter.

In response to an inspection request from KIOSK terminal 200, determination server 11 determines whether to allow gate passage on the basis of the user's passport number. In addition, determination server 11 accumulates and manages history information, such as determination histories, generated in system 10. Further, determination server 11 monitors operation states of a plurality of KIOSK terminals 200 and a plurality of gate apparatuses 100.

Coordination server 12 is a file server that divides network into a lower-level system (determination server 11, KIOSK terminal 200, and gate apparatus 100) and higher-level system (passport reader server 13, and manned-inspection gate apparatus 14), and exchanges required data therebetween. Note that determination server 11 may function as coordination server 12.

Passport reader server 13 is connected to determination server 11 to provide a variety of information of a passport to determination server 11.

Manned-inspection gate apparatus 14 is an apparatus for an inspector using a terminal and the like to make identification and determine whether to allow gate passage, unlike gate apparatus 100 which makes the identification in an unattended manner to open or close the open-close shutter.

Digital signage 15 is a display device that displays a guide on how to use the system 10 and the like. In accordance with an instruction from determination server 11, digital signage 15 can timely change the display content, and can change the display content in accordance with time of day. In addition, digital signage 15 has a screen switching function in case of emergency (interrupt display function).

Recorder (which may be referred to as an image monitoring terminal) 16 can accumulate, manage, and browse images of the monitoring camera provided in each KIOSK terminal 200 and each gate apparatus 100. Monitoring image recorder 16 is installed in each inspection site to continuously perform 24-hour, 365-day video recording. For example, image data for two weeks or more may be stored in accordance with the system configuration of inspection sites.

Operation monitoring terminal (which may be referred to as a history management terminal) 17 can monitor the running state of each equipment, and can search the running log of each equipment. In addition, operation monitoring terminal 17 can manage digital signage 15 (content registration, schedule registration and the like). Further, operation monitoring terminal 17 can access the database of determination server 11 to retrieve operation information and output operation statistics information and the like.

Operation state display plate 18 displays a list of operation states of the equipment. With this configuration, the administrator can monitor the processing state and the operation state of each equipment.

2. CONFIGURATION OF GATE APPARATUS

Figure 2:
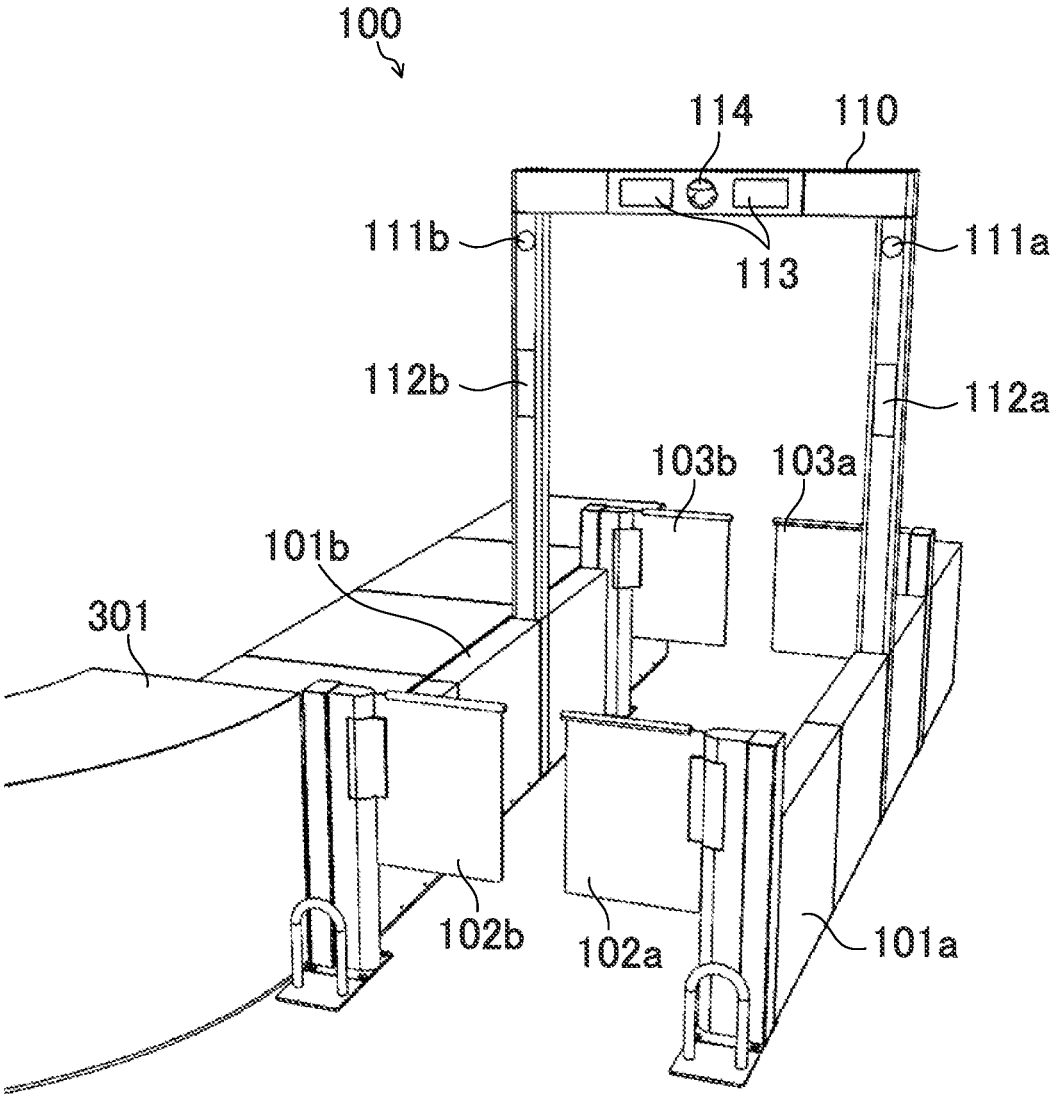
FIG. 2 is a perspective view illustrating an external configuration of the gate apparatus of an embodiment.
Figure 3:
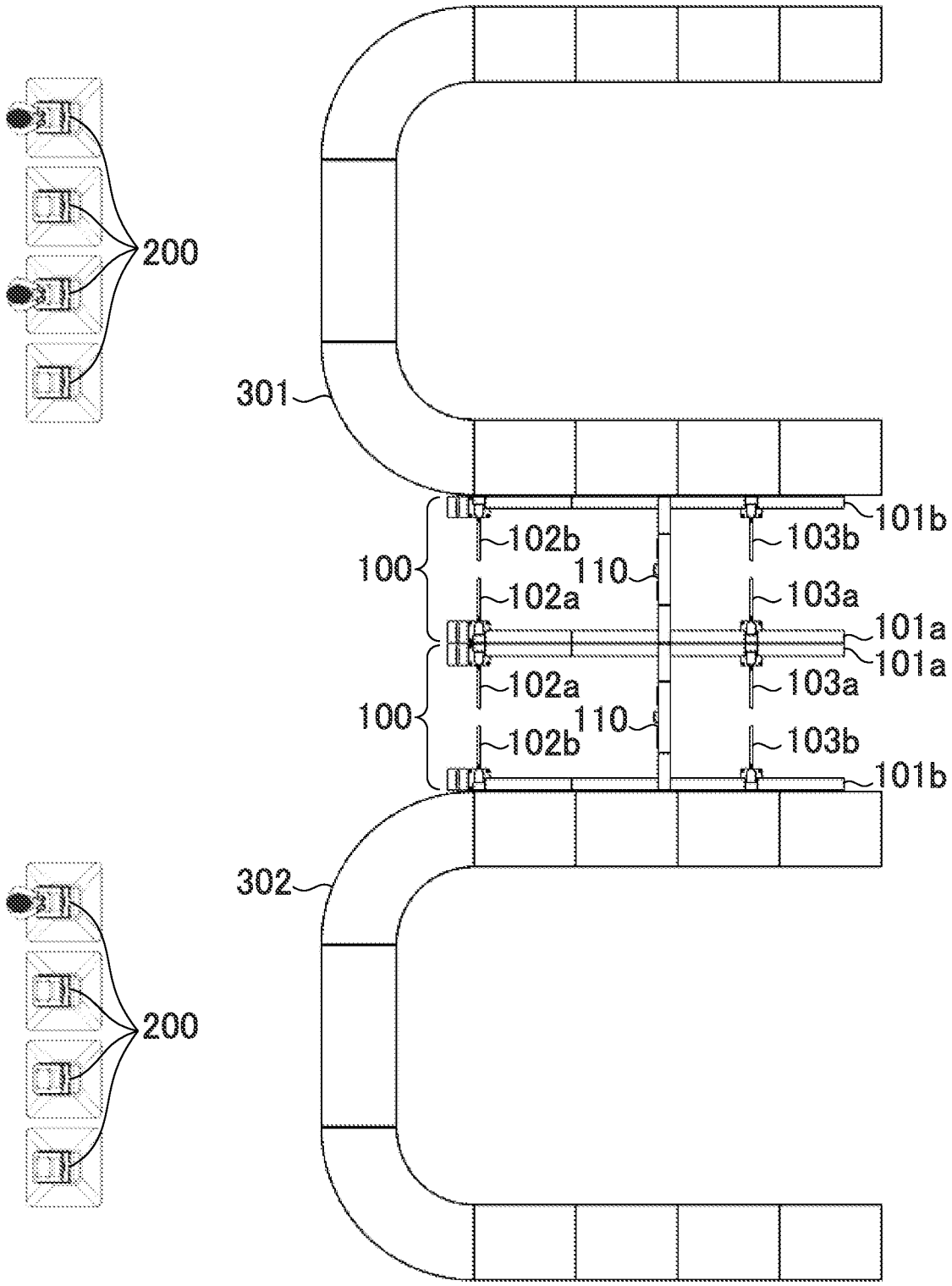
FIG. 3 is a plan view illustrating an actual layout of the gate apparatus.

FIG. 2 is a perspective view illustrating an external configuration of gate apparatus 100 of the present embodiment. FIG. 3 is a plan view illustrating a state where gate apparatus 100 is installed.

As illustrated in FIG. 2, gate apparatus 100 includes a pair of left and right passage walls 101*a* and 101*b* that define a passage for a person. Open-close shutters 102*a*, 102*b*, 103*a* and 103*b* for limiting the passing of a person are attached to passage walls 101*a* and 101*b*. In the drawing, open-close shutters 102*a*, 102*b*, 103*a* and 103*b* are attached to columns serving as a part of passage walls 101*a* and 101*b*. Open-close shutters 102*a* and 102*b* are open-close shutters for the entrance of gate apparatus 100, and open-close shutters 103*a* and 103*b* are open-close shutters for an exit of gate apparatus 100.

Arch 110 is provided as a bridge between the pair of left and right passage walls 101*a* and 101*b*. Arch 110 is attached to passage walls 101*a* and 101*b*. Arch 110 is provided between open-close shutters 102*a* and 102*b* for the entrance and open-close shutters 103*a* and 103*b* for exit. Arch 110 has a height that allows a person to pass therethrough in an attached state. The height of arch 110 is, for example, 200 to 250 [cm].

Arch 110 has a U-shape. Cameras 111*a* and 111*b* for facial photography are provided in left and right upright parts of arch 110. The upright part of arch 110 is provided at a height higher than other portions in gate apparatus 100, and thus the front face of a person passing through gate apparatus 100 can be easily captured by providing camera 111*a* or 111*b* at arch 110. In addition, as described later, a power supply line is disposed inside arch 110 and thus the distance of a laid line for supplying power to cameras 111*a* and 111*b* can be reduced by providing cameras 111*a* and 111*b* to arch 110.

In addition, lighting devices 112*a* and 112*b* are provided to left and right upright parts of arch 110. Lighting devices 112*a* and 112*b* are provided near cameras 111*a* and 111*b*, respectively. Lighting devices 112*a* and 112*b* are provided at position that can cause a person on the passage to face cameras 111*a* and 111*b*, and emit light with a light quantity that can draw the person's attention thereto. The light emission of the lighting devices is controlled based on the result of image capturing at cameras 111*a* and 111*b*. That is, when the face of a person who has entered gate apparatus 100 faces away from cameras 111*a* and 111*b* and the face image cannot be collated, the person's face can be directed toward lighting devices 112*a* and 112*b*, that is, toward cameras 111*a* and 111*b*, by emitting light from lighting devices 112*a* and 112*b*.

In addition, by providing cameras 111*a* and 111*b* to both upright parts, the face can be captured regardless of the direction of the person's face. As described later, gate apparatus 100 is used with an inspection table provided on the left or right of gate apparatus 100. As such, a person passing through gate apparatus 100 is likely to face the same direction as the inspection table to make conversation with the inspector, or is likely to face the opposite direction to avoid a question from the inspector. In view of this, such a movement of a person can be handled by providing cameras 111*a* and 111*b* to both upright parts of arch 110 on the left and the right of the passage of gate apparatus 100.

In addition, display unit 113 and monitoring camera 114 are provided at the upper part of arch 110. Display unit 113 indicates a display for instructing a person who has entered gate apparatus 100 to temporarily stop or move forward, or the like. Monitoring camera 114 captures images of the entirety of a person who has entered gate apparatus 100 and a region around gate apparatus 100. The captured image can be used for monitoring and obtaining an evidence of fraud perpetrated near image gate apparatus 100. Examples of fraud include fraudulent passage of a person passing through gate apparatus 100 in conspiracy with the inspector. For monitoring camera 114 installed for this purpose, it is preferable to provide a fish-eye camera and the like so that the fraud can be simultaneously captured in a wider range.

In addition, by providing display unit 113 at the upper part of arch 110, the line of sight of a person passing through gate apparatus 100 can be guided to display unit 113. With this configuration, it is possible to prevent a situation where a person's face captured at camera 111*a* or 111*b* is at an angle that is not suitable for the collation (downward angle).

Figure 7:
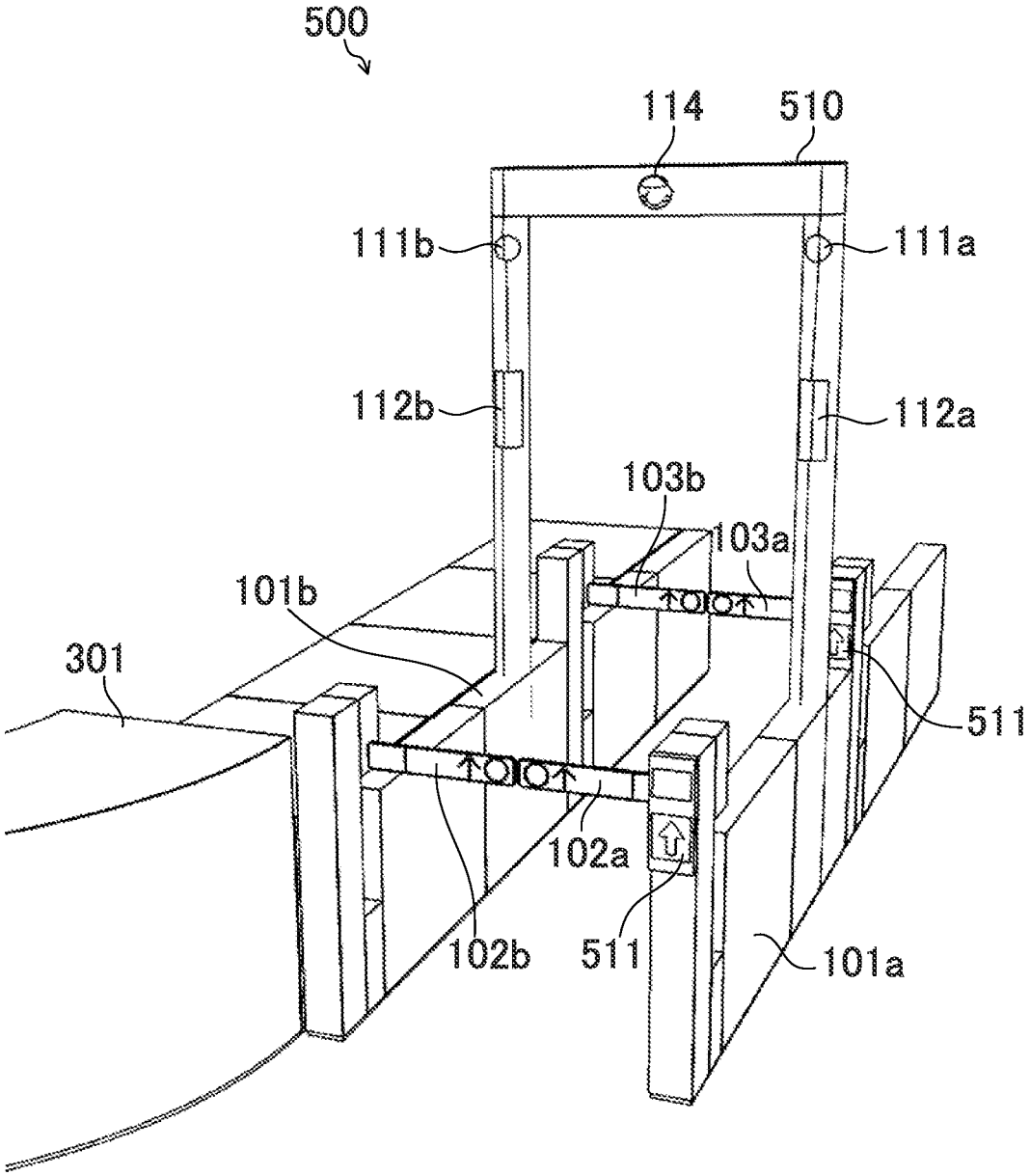
FIG. 7 is a perspective view illustrating an external configuration of a gate apparatus of another embodiment.

Note that when it is intended mainly to provide a warning, a notification or the like to a person who is waiting to pass through gate apparatus 100 and the like, display unit 113 may be provided on the front side of gate apparatus 100. For example, display unit 511 may be provided at a column on the entrance side or a column on the exit side of gate apparatus 500 as illustrated in FIG. 7. In FIG. 7, parts corresponding to those of FIG. 2 are denoted with the same reference numerals.

Here, when a person approaches open-close shutters 102*a* and 102*b* of gate apparatus 100, a sensor (not illustrated) detects the person to open open-close shutters 102*a* and 102*b* and thus the person can enter gate apparatus 100. When the person enters gate apparatus 100, cameras 111*a* and 111*b* capture the face image. Then, gate apparatus 100 makes identification, and the face image is sent to determination server 11. Then, when the person is identified as himself or herself, and is allowed to pass therethrough, open-close shutters 103*a* and 103*b* are opened such that the person can exit from gate apparatus 100.

In addition to the above-described configuration, a wiring (not illustrated) for supplying power to the electric apparatus provided in passage wall 101*a* is provided in arch 110. This wiring extends to the inside of passage wall 101*a* through the left upright part, the upper part, and the right upright part of arch 110. That is, the wiring is provided over substantially the whole circumference of arch 110. Note that in the present embodiment, the electric apparatus is a driving apparatus such as a motor that drives open-close shutters 102*a* and 103*a*.

Note that the cross-sectional shape of arch 110 is not limited as long as the wiring can pass therethrough. While the cross-sectional shape of arch 110 of FIG. 2 is a rectangular shape (i.e., the upright part has a rectangular prism shape), arch 510 may have a circular cross-sectional shape (i.e., the upright part has a columnar three-dimensional shape) as illustrated in FIG. 7, or other shapes, for example.

With arch 110 provided in the above-described manner and a power supply wiring provided in arch 110, the necessity to lay the wiring on the floor can be eliminated, and a bulge of the floor due to the wiring can be eliminated. As a result, the inconvenient task of carrying a heavy cart by pushing it over the bulge of the floor due to the wiring can be eliminated. In general, a main power-source line is extended to inspection table 301, and therefore, in a gate apparatus with no arch 110, it is necessary to lay a wiring on the floor from inspection table 301 to passage wall 101*a*, and as a result, a step is formed on the floor surface. In the present embodiment, such an inconvenience can be effectively eliminated with arch 110.

FIG. 3 is a plan view illustrating an actual layout of gate apparatus 100. In practice, a plurality of gate apparatuses 100 are arranged between inspection tables 301 and 302. In FIG. 3, two gate apparatuses 100 are arranged, but three or more gate apparatuses 100 may be arranged. In this case, to passage walls 101*b* adjacent to inspection tables 301 and 302, the power wiring can be directly pulled out from the main power-source line extended to the inspection table. In contrast, to passage walls 101*a* away from inspection tables 301 and 302, the wiring has to be extended from the main power-source line. In the present embodiment, this wiring is extended through arch 110 rather than laying it on the floor.

Figure 4A:
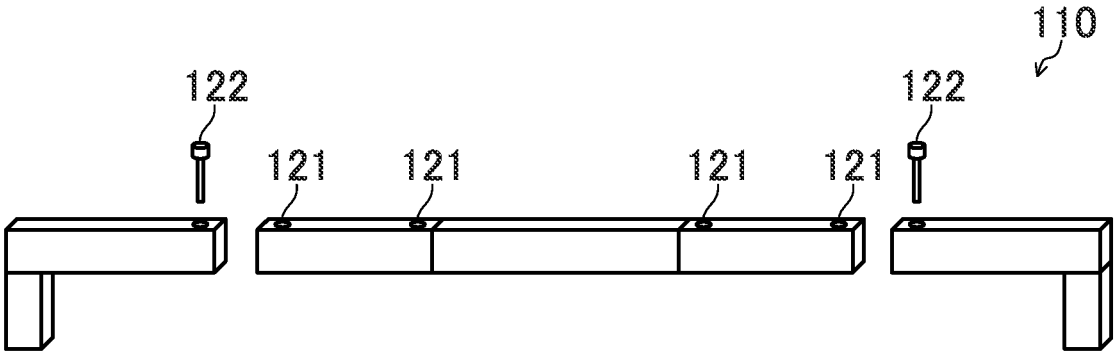
FIG. 4A to FIG. 4C are diagrams illustrating a telescopic mechanism of an arch.
Figure 4B:
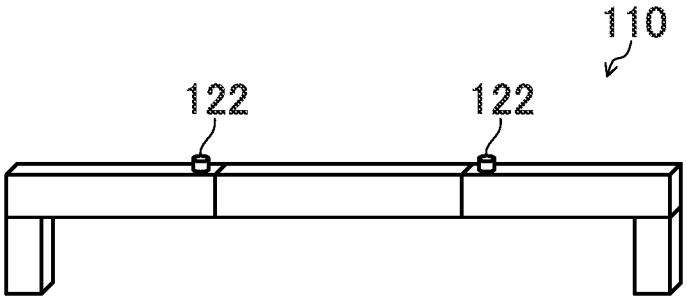
Figure 4C:
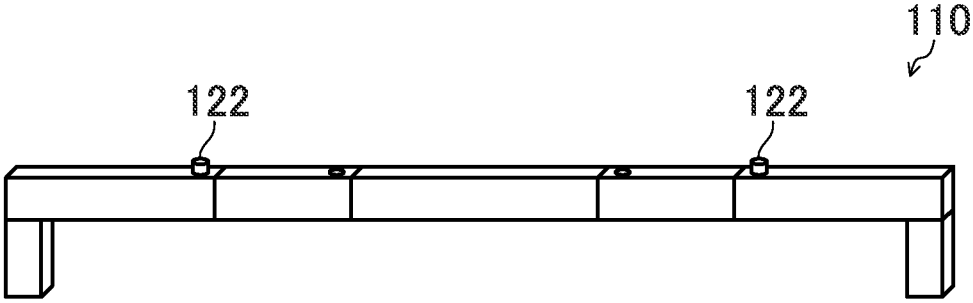

In addition to such a configuration, arch 110 is extendable in the horizontal direction. FIG. 4 is a drawing illustrating a telescopic mechanism of arch 110. Note that, for the sake of simplicity, display unit 113 and monitoring camera 114 illustrated in FIG. 2 are omitted in FIGS. 4A to 4C. As illustrated in FIG. 4A, the upper part of arch 110 is divided into a center part, a left part, and a right part. In the center part, adjustment holes 121 are formed, and by putting adjustment pin 122 to an adjustment hole selected from among the adjustment holes, the length of arch 110 in the horizontal direction can be adjusted. More specifically, arch 110 can be set to a contracted state by putting adjustment pin 122 in adjustment hole 121 on the inner side as illustrated in FIG. 4B. Arch 110 can be set to an extended state by putting adjustment pin 122 in adjustment hole 121 on the outer side as illustrated in FIG. 4C.

With arch 110 configured to be extendable in the horizontal direction, layout change can be flexibly achieved. For example, even when the layout is changed to change the length between inspection table 301 and inspection table 302 in FIG. 3, such layout change can be flexibly achieved. Naturally, even when the layout is changed to dispose three gate apparatuses 100 between inspection table 301 and inspection table 302, such layout change can be flexibly achieved.

3. CONFIGURATION OF KIOSK TERMINAL

Next, KIOSK terminal 200 is briefly described.

Figure 5:
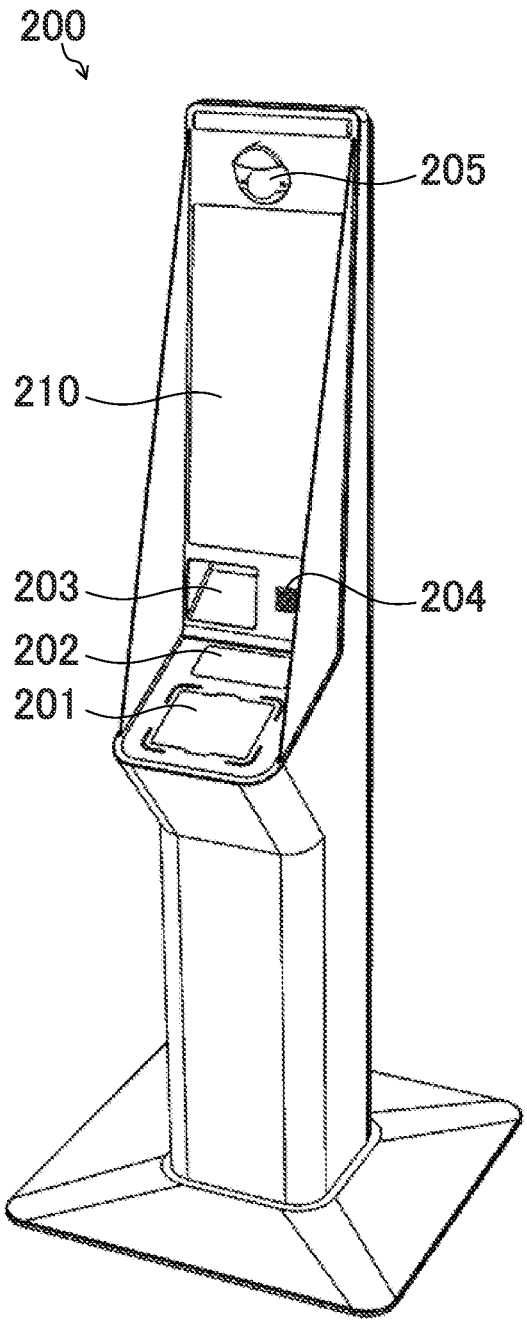
FIG. 5 is a perspective view illustrating an external configuration of a KIOSK terminal.

FIG. 5 is a perspective view illustrating an external configuration of KIOSK terminal 200. KIOSK terminal 200 is provided with passport reader 201, touch panel 202, QR code reader 203, speaker 204 and monitoring camera 205. In addition, KIOSK terminal 200 is provided with front panel 210 in which a half mirror is arranged. A facial recognition camera (not illustrated), a display unit and the like are provided on the back side of front panel 210.

4. DETECTION OF SUSPICIOUS PERSON

In the present embodiment, a passage limitation process unit is further provided such that the passage limitation process unit monitors the user's use state of KIOSK terminal 200 and the user's use state of gate apparatus 100 to perform a passage limiting process of limiting the user's passage through gate apparatus 100 on the basis of the use states. The passage limitation process unit may be implemented by determination server 11, gate apparatus 100 and the like, for example.

For example, the passage limitation process unit measures the time from a user's check-in at KIOSK terminal 200 to arrival at gate apparatus 100, and when the measurement time is equal to or longer than a predetermined threshold value, the passage limitation process unit issues an alarm to an inspector and/or performs a closing control of open-close shutters 103*a* and 103*b* on the exit side as the passage limiting process. Here, when the time from the check-in at KIOSK terminal 200 to the arrival at gate apparatus 100 is long, there is a possibility that the user stayed in the baggage handover area for long periods of time to rifle through other people's luggage, or hid someone else's luggage in the toilet, etc. Therefore, by performing the above-described passage limiting process in the above-described case, theft and the like can be prevented and the security can be improved.

In addition, for example, when the positional displacement between KIOSK terminal 200 where a user has checked in, and gate apparatus 100 from which the user has entered is greater than a predetermined value, the passage limitation process unit indicates an alarm display to the inspector and/or performs a closing control of open-close shutters 103*a* and 103*b* on the exit side as the passage limiting process.

Figure 6:
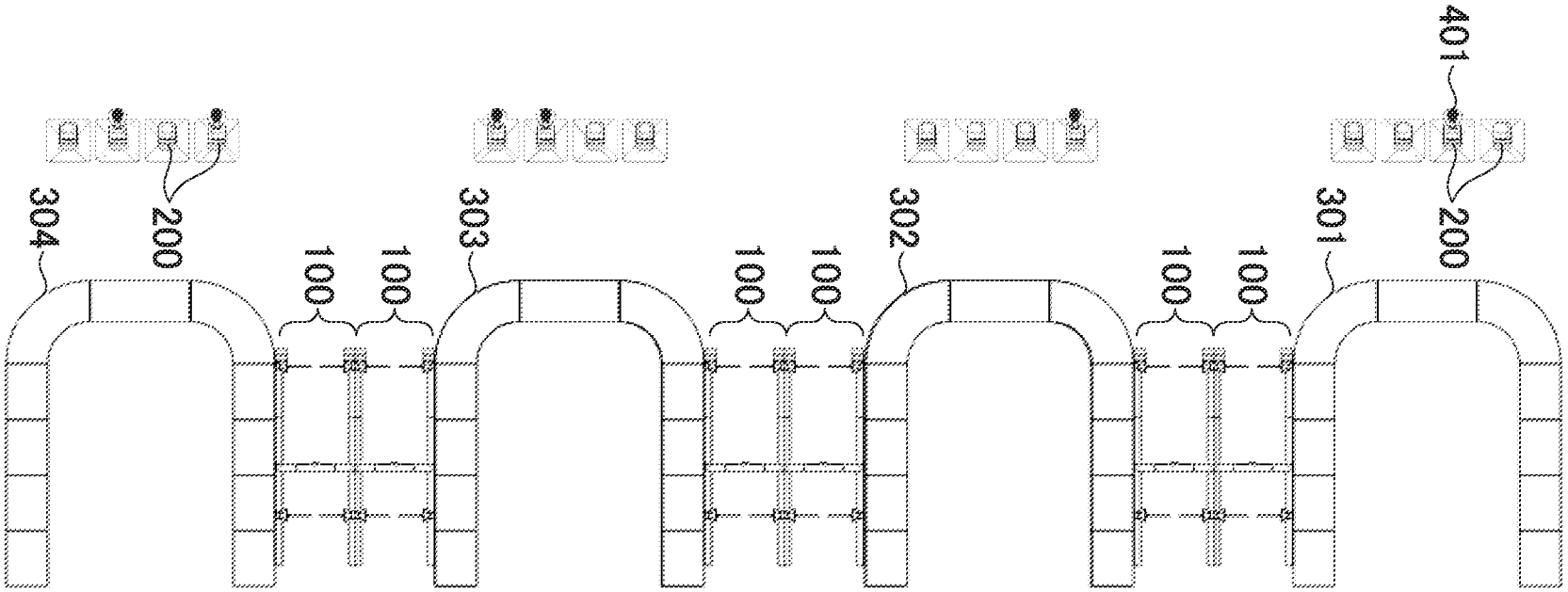
FIG. 6 is a diagram for describing a passage limiting process.

The above-described configuration is described with reference to FIG. 6. In the baggage handover area, a plurality of KIOSK terminals 200 and a plurality of gate apparatuses 100 are provided. Normally, a user who has checked in at a certain KIOSK terminal 200 should enter gate apparatus 100 close to that KIOSK terminal. For example, user 401 in FIG. 6 should enter gate apparatus 100 between inspection table 301 and inspection table 302. However, if user 401 enters gate apparatus 100 between inspection table 303 and inspection table 304, it is highly possible that user 401 has roamed the baggage handover area. In this case, by performing the above-described passage limiting process, theft and the like can be prevented, and the security can be improved.

5. CONCLUSION

As described above, according to the present embodiment, gate apparatus 100 includes the pair of left and right passage walls 101*a* and 101*b* that define a passage for a person, open-close shutters 102*a*, 102*b*, 103*a* and 103*b* attached to passage walls 101*a* and 101*b* and configured to limit passage of a person, and arch 110 attached as a bridge between the pair of passage walls 101*a* and 101*b*, arch 110 having a height that allows for passing of a person in an attached state, and including cameras 111*a* and 111*b* configured to capture an image of a person on a passage and a wiring configured to supply power to an electric apparatus provided in passage walls 101*a* and 101*b*. With this configuration, gate apparatus 100 that can eliminate inconveniences of the wiring can be achieved.

The above embodiments are only examples of embodiments in practice and should not be construed as limiting the technical scope of the present disclosure. In other words, the present disclosure may be implemented in various forms without deviating from the gist or the main features of the disclosure.

For example, in addition to the process of the embodiment, the display content of display unit 113 in arch 110 may be changed based on the number of persons passed through gate apparatus 100 in a unit time. For example, when the number of persons passed therethrough in a unit time is large, the waiting time of the user at gate apparatus 100 is long, and therefore the displayed guide may be changed to a gentle guide. In this manner, the user's frustration due to the long waiting time can be reduced.

Gate apparatus 100 of the embodiment is applicable not only to baggage handover areas in airports, but also to event sites.

In gate apparatus 100 of the embodiment, cameras 111*a* and 111*b* are provided in the left and right upright parts, but cameras 111*a* and 111*b* may be provided in only one of the left and right parts. In such a case, lighting devices 112*a* and 112*b* may be provided to only one of them provided with the camera. The reason for this is that since the lighting device is installed to direct the person's face to the camera as described above, it suffices that the lighting device is installed in a region near the camera, and that the opposite effect results if the lighting device is installed at a position remote from the camera. Note that the region near the camera includes at least a region of the upright part where the camera is installed. In addition, since the image used for collating the face is preferably a person's front face, it is preferable to provide the lighting device at a position where the person's face can be directed to a desired angle also in the vertical direction. For example, as illustrated in FIG. 2, when cameras 111*a* and 111*b* are provided near the top of arch 110, it is desirable to provide lighting devices 112*a* and 112*b* near the top. Such a position is also included in the region near the camera.

While the check-in of the user is performed with a dedicated KIOSK terminal 200 in the embodiment, the check-in may be performed with another apparatus. For example, when it is intended only for face registration, any camera-equipped terminals may be used. In addition, the configuration of KIOSK terminal 200 is not limited to that of the embodiment. In the embodiment, KIOSK terminal 200 has functions for collecting information specific to airports such as reading of passports, and entry in a customs declaration because a baggage handover area in an airport is assumed. When it is intended for authorization of a person passing through gate apparatus 100, it suffices to provide a function for acquiring a face image used for a collation (in the embodiment, a face image of a passport). That is, the minimum process required as a check-in process is acquisition of a face image used for a collation in the form of an identification or a live photography, and other functions may be appropriately added or omitted in accordance with installation situation of systems.

This application is entitled to and claims the benefit of Japanese Patent Application No. 2018-123002 filed on Jun. 28, 2018, the disclosure each of which including the specification, drawings and abstract is incorporated herein by reference in its entirety.

INDUSTRIAL APPLICABILITY

The present disclosure is applicable to a gate apparatus and a system disposed in a baggage handover area of an airport, for example.

REFERENCE SIGNS LIST

10 System
100, 500 Gate apparatus
101*a*, 101*b* Passage wall
102*a*, 102*b*, 103*a*, 103*b* Open-close shutter
110, 510 Arch
111*a*, 111*b* Camera
112*a*, 112*b* Lighting device
113, 511 Display unit
114, 205 Monitoring camera
121 Adjustment holes
122 Adjustment pin
200 KIOSK terminal
201 Passport reader
202 Touch panel
203 QR code reader

The invention claimed is:

1. A gate apparatus comprising:

a pair of left and right passage walls defining a passage;

an open-close shutter attached to the passage walls and configured to limit passing of a person through the passage; and an arch attached as a bridge between the passage walls, and having a height enough to allow passing of a person thereunder in a state where the arch is attached, the arch including a camera configured to capture an image of a person passing through the passage and a wiring configured to supply power to an electric apparatus provided in the passage walls, wherein:

the arch is provided with a display; and display content of the display is changed based on the number of persons passed through the gate apparatus in a unit time.

2. The gate apparatus according to claim 1, wherein the camera is provided in left and right upright parts of the arch.

3. The gate apparatus according to claim 2, wherein the camera is provided in each of the left and right upright parts of the arch.

4. The gate apparatus according to claim 1, wherein the arch includes a lighting device.

5. The gate apparatus according to claim 4, wherein the lighting device is provided near a position where the camera is installed.

6. The gate apparatus according to claim 4, wherein light emission of the lighting device is controlled based on a result of image capturing at the camera.

7. The gate apparatus according to claim 1, wherein the electric apparatus includes a driving apparatus configured to drive the open-close shutter.

8. The gate apparatus according to claim 1, wherein the arch is extendable in a horizontal direction.

9. A system comprising:

a terminal configured to perform a check-in process of a user when user information is input, and a gate apparatus including a camera and an open-close shutter, and configured to control opening and closing of the open-close shutter at least on a basis of a result of a collation of a face image of the user input to the terminal and an face image of the user captured by the camera; and a passage limitation processor configured to monitor a use state of the terminal by the user and a use state of the gate apparatus by the user and perform a passage limiting process of limiting passing of the user through the gate apparatus on a basis of the use states, wherein the passage limitation processor measures a time from a check-in of the user at the terminal to arrival at the gate apparatus, issues an alarm to an official, and performs the passage limiting process when a measured time is equal to or greater than a predetermined threshold value.

10. The system according to claim 9, wherein the passage limiting process performed at the passage limitation processor includes a display of an alarm to an inspector or a closing control of the open-close shutter.

11. The A system according to claim 9, including comprising:

a plurality of terminals each configured to perform a check-in process of a user when user information is input;

a plurality of gate apparatuses each including a camera and an open-close shutter, and configured to control opening and closing of the open-close shutter at least on a basis of a result of a collation of a face image of the user input to a respective said terminal of the plurality of terminals and an face image of the user captured by the camera; and a passage limitation processor configured to monitor a use state of the said terminal by the user and a use state of a said gate apparatus of the plurality of gate apparatuses by the user and perform a passage limiting process of limiting passing of the user through the said gate apparatus on a basis of the use states, wherein the passage limitation processor performs the passage limiting process when a positional displacement between the said terminal at which the user has performed a check-in and the said gate apparatus where the user has entered is greater than a predetermined value.

12. The system according to claim 11, wherein the passage limiting process performed at the passage limitation processor includes a display of an alarm to an inspector or a closing control of the open-close shutter.

* * * * *